US008857522B2

(12) United States Patent
Arrazola et al.

(10) Patent No.: US 8,857,522 B2
(45) Date of Patent: Oct. 14, 2014

(54) ELECTRICALLY-POWERED SURFACE-CONTROLLED SUBSURFACE SAFETY VALVES

(71) Applicants: Alvaro Jose Arrazola, Houston, TX (US); Melvin Clark Thompson, San Ramon, CA (US)

(72) Inventors: Alvaro Jose Arrazola, Houston, TX (US); Melvin Clark Thompson, San Ramon, CA (US)

(73) Assignee: Chevron U.S.A., Inc., San Ramon, CA (US)

( * ) Notice: Subject to any disclaimer, the term of this patent is extended or adjusted under 35 U.S.C. 154(b) by 0 days.

(21) Appl. No.: 14/030,841

(22) Filed: Sep. 18, 2013

(65) Prior Publication Data

US 2014/0144649 A1 May 29, 2014

Related U.S. Application Data

(63) Continuation-in-part of application No. PCT/US2013/031526, filed on Mar. 14, 2013.

(60) Provisional application No. 61/731,332, filed on Nov. 29, 2012.

(51) Int. Cl.
*E21B 34/06* (2006.01)
*E21B 34/10* (2006.01)

(52) U.S. Cl.
CPC ..... *E21B 34/066* (2013.01); *E21B 34/10* (2013.01)
USPC ..... 166/363; 166/368; 166/373; 166/66.6

(58) Field of Classification Search
CPC ..... E21B 34/066; E21B 47/12; F16K 31/047
USPC ..... 166/363, 368, 373, 386, 66.6; 251/69; 340/853.1
See application file for complete search history.

(56) References Cited

U.S. PATENT DOCUMENTS 4,308,499 A 12/1981 Thierbach et al.
4,981,173 A * 1/1991 Perkins et al. ..... 166/66.7

(Continued)

FOREIGN PATENT DOCUMENTS

EP 1193368 4/2002
GB 2076039 11/1981

(Continued)

OTHER PUBLICATIONS

International Search Report for PCT/US2013/031526 mailed May 7, 2014.
International Search Report for PCT/US2011/060454 mailed Jan. 22, 2014.

*Primary Examiner* — Matthew Buck
(74) *Attorney, Agent, or Firm* — King & Spalding LLP

(57) ABSTRACT

A subsurface safety valve system for a wellbore within a subterranean formation is described. The system can include a power source that generates power, and a delivery system disposed within the wellbore and electrically coupled to the power source. The system can also include at least one safety valve disposed within the wellbore and electrically coupled to the delivery system, where the at least one safety valve remains open while the at least one safety valve receives the power from the delivery system, and where the at least one safety valve closes when the at least one safety valve stops receiving power from the delivery system. The system can further include production tubing mechanically coupled to a distal end of the at least one safety valve, where the at least one safety valve shuts in a cavity within production tubing when the at least one safety valve closes.

20 Claims, 6 Drawing Sheets

(56) References Cited

U.S. PATENT DOCUMENTS

| | | | | |
|---|---|---|---|---|
| 5,070,595 | A * | 12/1991 | Perkins et al. | 29/602.1 |
| 5,070,944 | A * | 12/1991 | Hopper | 166/66.7 |
| 6,619,388 | B2 * | 9/2003 | Dietz et al. | 166/66.7 |
| 6,633,236 | B2 | 10/2003 | Vinegar et al. | |
| 6,681,861 | B2 * | 1/2004 | Davidson et al. | 166/382 |
| 6,766,141 | B1 | 7/2004 | Briles et al. | |
| 7,158,049 | B2 | 1/2007 | Hoefel et al. | |
| 7,640,989 | B2 * | 1/2010 | Williamson et al. | 166/332.8 |
| 8,077,053 | B2 * | 12/2011 | Thompson et al. | 340/855.7 |
| 2002/0126021 | A1 | 9/2002 | Vinegar | |
| 2004/0173362 | A1 * | 9/2004 | Waithman et al. | 166/386 |
| 2007/0235184 | A1 | 10/2007 | Thompson et al. | |
| 2008/0253230 | A1 | 10/2008 | Thompson et al. | |
| 2009/0159361 | A1 | 6/2009 | Coates et al. | |
| 2009/0174409 | A1 | 7/2009 | Coates et al. | |
| 2011/0155381 | A1 * | 6/2011 | Reaux | 166/334.1 |
| 2011/0186303 | A1 * | 8/2011 | Scott et al. | 166/373 |

FOREIGN PATENT DOCUMENTS

| | | |
|---|---|---|
| WO | WO 82/02754 | 8/1982 |
| WO | WO 97/16751 | 5/1997 |

* cited by examiner

ELECTRICALLY-POWERED SURFACE-CONTROLLED SUBSURFACE SAFETY VALVES

CROSS-REFERENCE TO RELATED APPLICATION

This application is a continuation-in-part of and claims priority to International Patent Application Number PCT/US2013/031526, titled "Transmitting Power Within a Wellbore" and filed on Mar. 14, 2013, which claims priority to U.S. Provisional Patent Application Ser. No. 61/731,332, titled "Method, System and Apparatus for Transmitting Power into a Wellbore" and filed on Nov. 29, 2012. The entire contents of the foregoing applications are hereby incorporated herein by reference.

TECHNICAL FIELD

The present disclosure relates generally to surface-controlled subsurface safety valves (also called "SCSSVs") in a subterranean wellbore, and more specifically to electrically-powered surface-controlled subsurface safety valves in a subterranean wellbore.

BACKGROUND

In the production of oil and gas from a wellbore, safety valves are almost always required to be installed within the wellbore. The safety valves are designed to isolate the wellbore in the event of an operational condition that can result in damage at or near the surface. The operation of safety valves can become problematic in deepwater wells, where thousands of feet of hydrostatic pressure can build up even before entering the wellbore. Existing safety valves operate using hydraulics, Nitrogen, and/or magnets.

Subterranean wellbores may be drilled and constructed several miles below the ground or seabed. It is difficult or inconvenient to deliver electrical power to downhole equipment in such harsh environments. In some cases, electrical cables are installed in the wellbore, but such cables sometimes are difficult and expensive to install and maintain in an operationally secure manner. In addition, it can be difficult to install a cable in the confined space of a well for distances of several thousand feet, from the surface to downhole power consuming devices. Additionally, such cables may become eroded or damaged during installation or during use. Such damage may require costly workovers and delays in oil and gas production.

SUMMARY

In general, in one aspect, the disclosure relates to a subsurface safety valve system for a wellbore within a subterranean formation. The system can include a power source that generates power. The system can also include a delivery system disposed within the wellbore and electrically coupled to the power source, where the delivery system delivers the power generated by the power source. The system can further include at least one safety valve disposed within the wellbore and electrically coupled to the delivery system, where the at least one safety valve remains open while the at least one safety valve receives the power from the delivery system, and where the at least one safety valve closes when the at least one safety valve stops receiving power from the delivery system. The system can also include production tubing mechanically coupled to a distal end of the at least one safety valve, where the production tubing includes a cavity, where the at least one safety valve shuts in the cavity when the at least one safety valve closes.

In another aspect, the disclosure can generally relate to method for closing off production tubing disposed in a wellbore of a subterranean formation. The method can include delivering, using a delivery system, power to at least one safety valve positioned in the wellbore, where the at least one valve is mechanically coupled in series with a first tubing string and a second tubing string, where the first tubing string is disposed below the at least one safety valve, and where the second tubing string is disposed above the at least one safety valve, where the power holds open the at least one safety valve. The method can also include terminating, in response to detecting an operating condition that surpasses an operating threshold value, the power delivered to the at least one safety valve, where the at least one safety valve closes when the power is terminated.

These and other aspects, objects, features, and embodiments will be apparent from the following description and the appended claims.

BRIEF DESCRIPTION OF THE DRAWINGS

The drawings illustrate only example embodiments of methods, systems, and devices for electrically-powered surface-controlled subsurface safety valves and are therefore not to be considered limiting of its scope, as electrically-powered surface-controlled subsurface safety valves may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
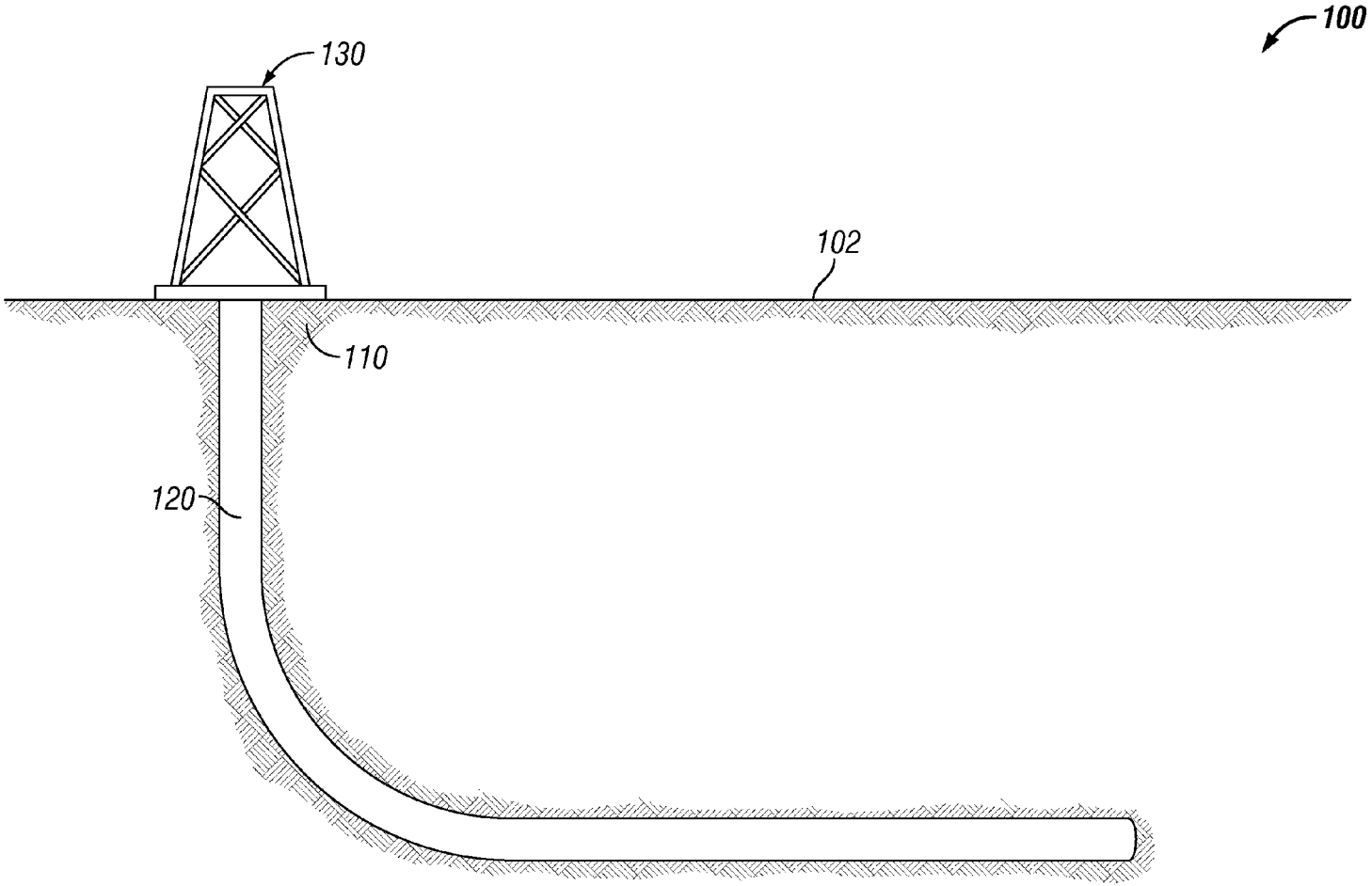
FIG. 1 shows a schematic diagram of a land-based field system in which electrically-powered surface-controlled subsurface safety valves can be used in accordance with certain example embodiments.

Example embodiments directed to electrically-powered surface-controlled subsurface safety valves will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. Terms such as "first," "second," "top," "bottom," "distal," "proximal," "left," and "right" are used merely to distinguish one component (or part of a component) from another. Such terms are not meant to denote a preference or a particular orientation.

The SCSSV is often integrated with tubing and is set inside the wellbore at a depth specified by one or more of a number of factors. Such factors can include, but are not limited to, applicable regulations, flow assurance estimates, and hydrostatic pressure. Often, in offshore (non-land-based) production applications, SCSSVs must be set a minimum of 150 feet below the mudline (i.e., at the point where the water meets land). This requirement is largely driven by regulatory requirements that are designed to provide well control in case of a catastrophe.

Due to cold temperatures and the formation of hydrates found in offshore sites, a common practice is to set the valves at a point where the local geothermal gradient (degrees of temperature per foot of depth) allows the ambient temperature of the setting point for the subsurface safety valve (also called "SSV") within the well to be at a depth where the in situ temperature is above the hydrate formation temperature. SSVs typically require a change in conditions to activate the closure mechanism. SCSSVs typically are hydraulically controlled by a control line that runs between the SCSSV and a surface control panel. A reduction in pressure in the control line will close the SCSSV. Existing SCSSVs can also be controlled by nitrogen and/or magnets.

The maximum setting depth of a SCSSV can be a function of one or more of a number of factors, including but not limited to the closing spring force of the SCSSV, the area of the piston(s) of the SCSSV, hydraulic fluid density of the SCSSV, and internal pressure of the SCSSV. Typical designs of SCSSVs are challenged at deeper setting depths because of limitations on spring/piston designs. While high opening pressures are normally not an issue in dry tree applications, the cost of the subsea systems and umbilicals in deepwater applications can be significant, especially as the working pressure exceeds 10,000-15,000 pounds per square inch (psi).

With the example embodiments described herein, where the SCSSV is electrically powered, a delivery system that can deliver an adequate amount of power to operate the SCSSV within the wellbore is needed. For example, the SCSSV can require at least 400 Watts (e.g., 500 Watts) of power delivered to its downhole location. Multiple delivery systems can be used, but the cost of using some traditional electric delivery systems can be cost-prohibitive. An example of a cost-prohibitive delivery system is running a cable from a power source located at or near the surface downhole to the SCSSV.

One example of a delivery system that is cost-effective is described below with respect to FIGS. 3 and 4. Specifically, the delivery system provides a balance of voltage versus current for a given power requirement within the wellbore. A higher voltage and lower current density may be required. High voltage may impact the insulation systems, while high current may impact resistive losses, causing undesirable electric etching and heating in the interfaces or conductors. In some example embodiments, a significant effort can be made to operate the system voltage as high as possible to reduce the system current to a level that is as low as possible. High system current may result in a voltage gradient from wellhead to casing end on the outer surface of the casing, which is undesirable. However, it is recognized that many different voltage, amperage, and power requirements could be used with example embodiments, and that example embodiments are not limited to any particular voltage, amperage, or power values.

The case for higher system voltage (i.e., lower current) has advantages in certain example embodiments. An isolator sub (described below) is an insulating short joint section, one of which can be located near the wellhead, that allows a break in metallic or conductor connection between its two ends. This allows the string tubing below the isolator sub to be electrically insulated from the string tubing above the isolator sub. If another isolator sub is placed at the bottom of the tubing string in the wellbore, a portion of tubing string (the power-transmitting section of the tubing string, as defined below in FIGS. 3 and 4) can be excited electrically to carry current to the SCSSV positioned within the wellbore. Example embodiments described herein provide not only inductive isolation of the voltage-transmitting section of the tubing string, but also dielectric isolation. Thus, systems using example embodiments can deliver higher voltages and/or currents to an electrical device within a wellbore.

A user as described herein may be any person that is involved with a piping system in a subterranean wellbore and/or transmitting power within the subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

FIG. 1 shows a schematic diagram of a land-based field system 100 in which electrically-powered SCSSVs can be used within a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., extract downhole materials) the wellbore 120. The field equipment 130 can be positioned and/or assembled at the surface 102. The field equipment 130 can include, but is not limited to, a derrick, a tool pusher, a clamp, a tong, drill pipe, a drill bit, example isolator subs, tubing pipe, a power source, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe to be inserted at a certain depth in the wellbore 120.

Figure 2B:
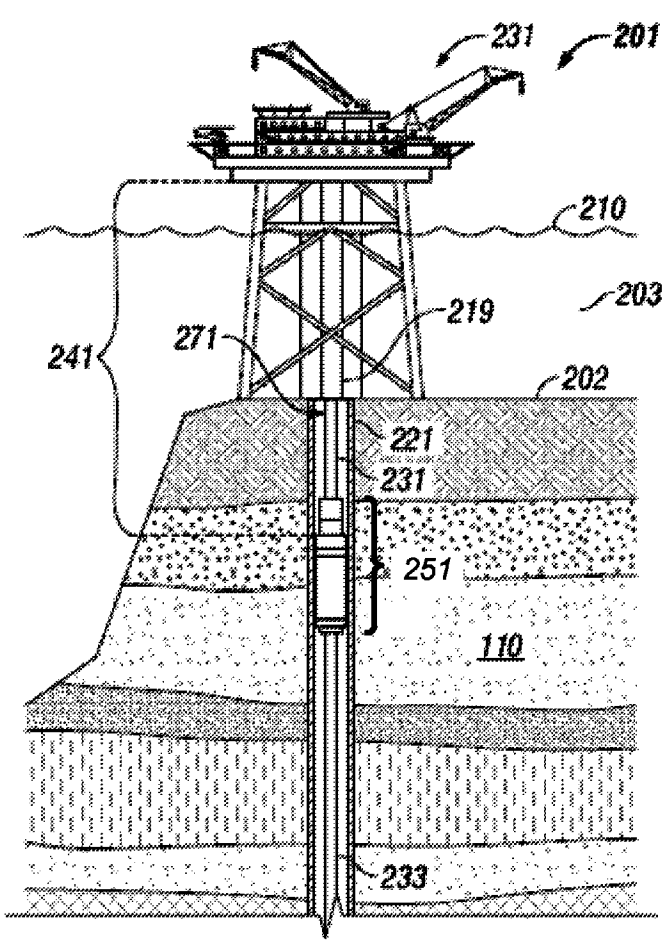
FIGS. 2A and 2B show schematic diagrams of offshore field systems in which electrically-powered surface-controlled subsurface safety valves can be used in accordance with certain example embodiments.
Figure 2A:
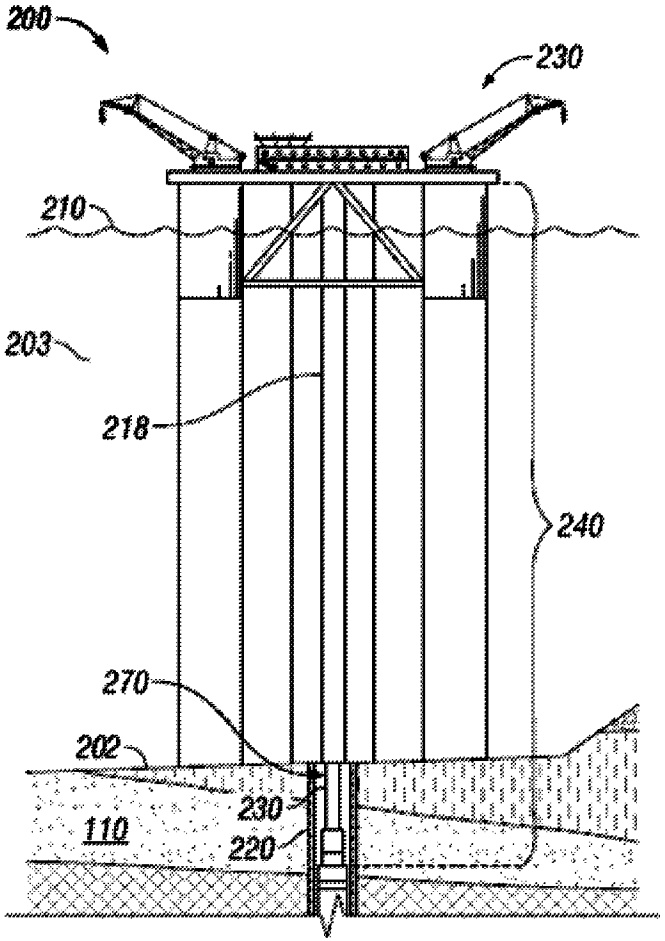

FIGS. 2A and 2B show schematic diagrams of offshore field systems 200 and 201, respectively, in which electrically-powered SCSSVs can be used in accordance with certain example embodiments. Specifically, FIG. 2A shows an offshore field system 200 in which the field equipment 230 includes a semi-submersible platform. FIG. 2B shows another offshore field system 200 in which the field equipment 231 includes a jack-up platform. In one or more embodiments, one or more of the features shown in FIGS. 2A and 2B may be omitted, added, repeated, and/or substituted. Accordingly, embodiments of a field system should not be considered limited to the specific arrangements of components shown in FIGS. 2A and 2B.

The field system 200 of FIG. 2A can use a semi-submersible platform because of the depth of the water 203. For example, the depth of the water 203 in FIG. 2A (i.e., the distance between the water level 210 and the mudline 202) can be more than approximately five hundred feet (e.g., five thousand feet). The field system 201 of FIG. 2B can use a jack up platform because of the depth of the water 203 is less than approximately 500 feet (e.g., 200 feet).

In addition to the wellbore 220 in FIG. 2A, the field system 200 shows a piping system 270 that includes a riser 218 disposed in the water 203, followed in vertical depth by a tubing string 230 disposed in the wellbore 220 closest to the mudline 202. The riser 218 can have a cavity along its length into which a tubing string can be disposed. The tubing string 230 and the tubing string within the riser 218 can be joined by a subsea tree (not shown) located at or near the mudline 202. The tubing string 230 can include a number of tubing pipes and, in certain example embodiments, a SCSSV. As stated above, regulations and safety considerations often require that the SCSSV be located at least 150 feet below the mudline 202. In other words, in a deepwater field system, the SCSSV cannot be located in the water 203, but instead must be disposed in the wellbore 220.

For a typical hydraulic SCSSV, the hydrostatic pressure 240 at this depth (calculated as the product of the depth from approximately the water level 210 to the SCSSV, gravity, and the density of the water) is one of a number of forces that must be considered to determine the fail safe setting depth of the SCSSV. Other forces to consider can include, but are not limited to, friction and the weight of the moving parts. Countering these forces is the spring force of the SCSSV. Thus, the greater the distance between the location of the SCSSV and the platform (in this case, approximately the water level 210), the greater the demand on the SCSSV in remaining open during normal operating conditions.

The tubing string 231 of FIG. 2B is substantially similar to the tubing string 230 of FIG. 2A. Specifically, the tubing string 231 includes a tubing string 219 disposed in the water 203, followed in vertical depth by a tubing string 231 disposed in the wellbore 221 closest to the mudline 202. The tubing string 231 and the tubing string 219 can be part of a continuous tubing string. Below the tubing string 231 can be a string assembly 251, which can include a SCSSV. FIG. 2B also shows, as part of the piping system 271, a tubing string 233 that is mechanically coupled to the distal end of the string assembly 251 and continues further into the wellbore 221.

Figure 3:
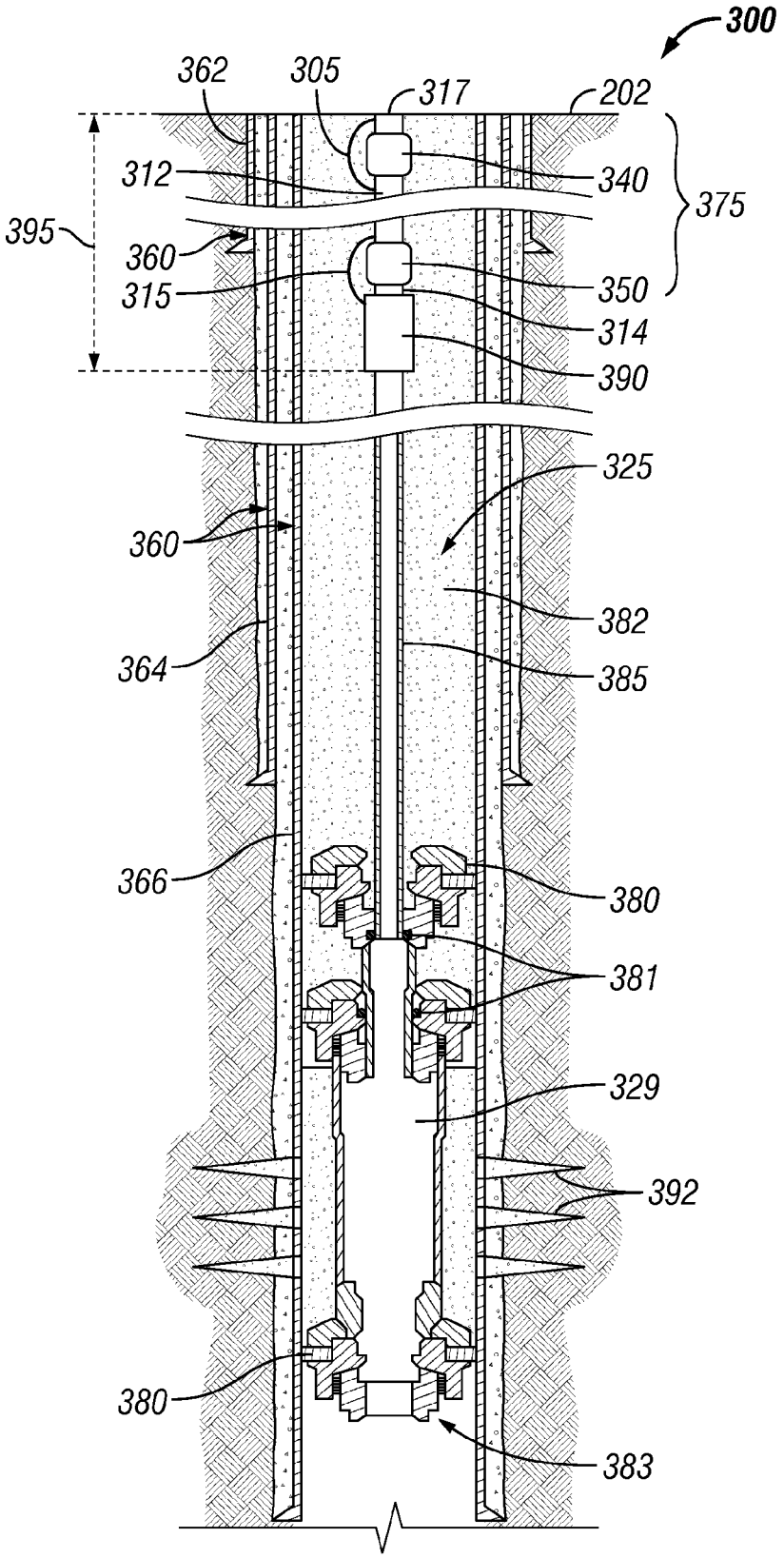
FIG. 3 shows a cross-sectional side view of a production wellbore that includes an example electrically-powered surface-controlled subsurface safety valve in accordance with certain example embodiments.

FIG. 3 shows a cross-sectional side view of a production wellbore 300 that includes an example electrically-powered surface-controlled subsurface safety valve 390 in accordance with certain example embodiments. In one or more embodiments, one or more of the features shown in FIG. 3 may be omitted, added, repeated, and/or substituted. Accordingly, embodiments of a production wellbore should not be considered limited to the specific arrangements of components shown in FIG. 3.

Referring to FIGS. 1, 2, and 3, the production wellbore 300 includes a delivery system 375, below which is mechanically coupled a SCSSV 390, below which is mechanically coupled production tubing 385. The delivery system 375, the SCSSV 390, and the production tubing 385 are all disposed within a cavity 325 formed by the casing 360 throughout the wellbore 120. The casing 360 in this case has multiple sections (casing section 362, casing section 364, and casing section 366) that are layered within each other, where the inner most section (casing section 366) has the smallest diameter and extends the furthest into the wellbore 120.

The delivery system 375 can include, at least, one or more tubing pipes (e.g., tubing pipe 317, tubing pipe 312, tubing pipe 314), one or more isolator subs (e.g., top isolator sub 340, bottom isolator sub 350), and one or more cables (e.g., cable 305, cable 315). The delivery system 375 can be long enough so that the SCSSV 390 is positioned at a certain depth 395 (the setting depth) below the mudline 202 (or, alternatively, the water level 210 or the surface 102). More details of the delivery system 375 are described below with respect to FIG. 4.

Toward the bottom of the wellbore 120 within the cavity 325 is one or more packers 380 and one or more seals 381. As described below with respect to FIG. 4, the packers 380 and/or seals 381 can be a conductive interface to provide a return path for the power delivered to the SCSSV 390. Below the packers 380 and seals 381 is a production zone 329 having a number of perforations 392 that extend through the casing section 366 and the wellbore 120 into the formation 110. The perforations 392 allow production fluid to flow from a reservoir in the formation 110 into the production zone 329. Below the perforations 392 within the wellbore 120 can be positioned another packer 380 that is mechanically coupled to an end cap 383.

Figure 4:
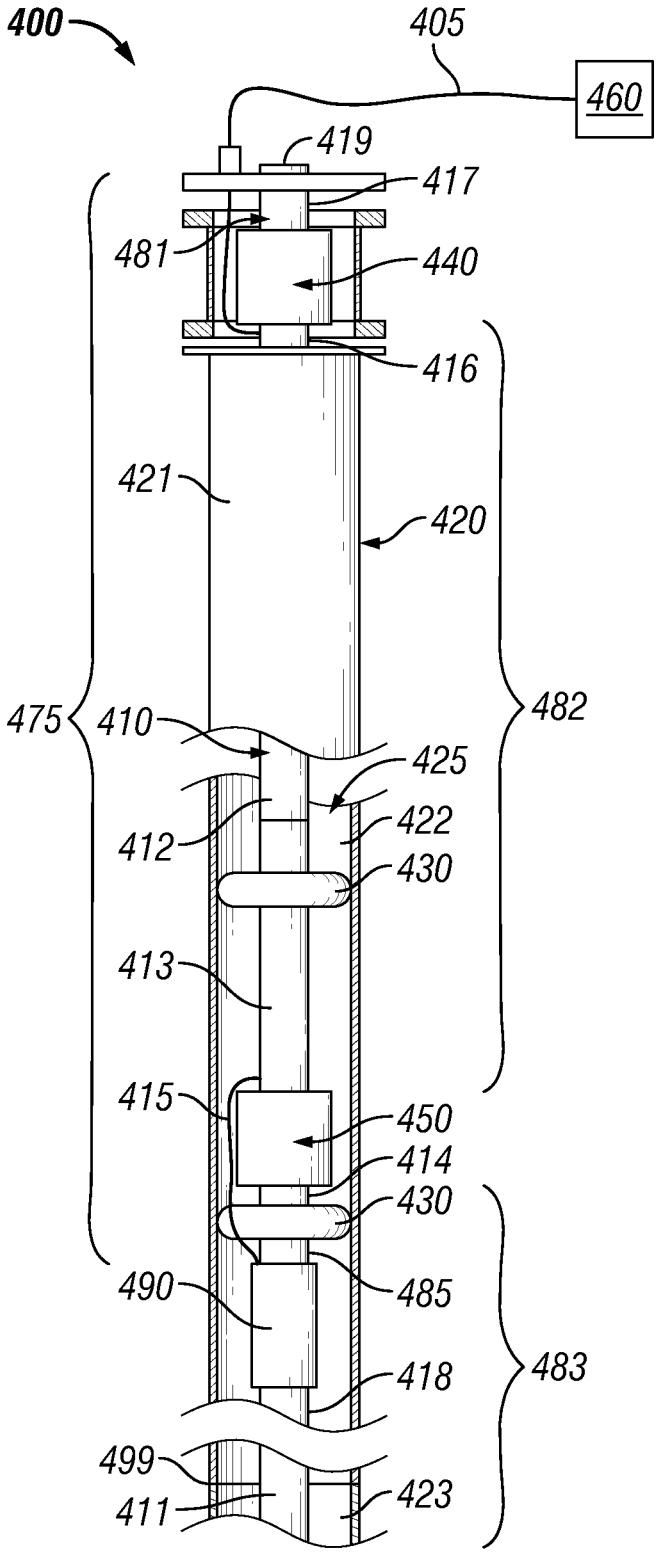
FIG. 4 shows a semi-cross-sectional side view of a production wellbore that includes another example electrically-powered surface-controlled subsurface safety valve in accordance with certain example embodiments.

FIG. 4 shows a semi-cross-sectional side view of a delivery system 475 as part of a piping system 400 that includes another example electrically-powered SCSSV 490 in accordance with certain example embodiments. In one or more embodiments, one or more of the features shown in FIG. 4 may be omitted, added, repeated, and/or substituted. Accordingly, embodiments of a production wellbore should not be considered limited to the specific arrangements of components shown in FIG. 4.

The delivery system 475 can include a casing 420, a tubing string 410, a power source 460, a top isolator sub 440, a bottom isolator sub 450, the SCSSV 490, a number of centralizers 430, and a conductive interface 499. Referring to FIGS. 1, 2, and 3, some or all of the delivery system 475 can be disposed in the wellbore 120. The delivery system 475 can be electrically coupled to a power source 460, and deliver power generated by the power source 460 to the SCSSV 490. The casing 420 includes a number of casing pipes (e.g., casing pipe 421, casing pipe 422, casing pipe 423) that are mechanically coupled to each other end-to-end, usually with mating threads. The casing pipes of the casing 420 can be mechanically coupled to each other directly or using a coupling device, such as a coupling sleeve.

Each casing pipe of the casing 420 can have a length and a width (e.g., outer diameter). The length of each casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of the casing pipe is circular, the width can refer to an outer diameter, an inner diameter, or some other form of measurement of the casing pipe. Examples of a width in terms of an outer diameter can include, but are not limited to, 7⅝ inches, 9⅝ inches, 10¾ inches, 13⅜ inches, and 14 inches.

The size (e.g., width, length) of the casing 420 is determined based on the information gathered using field equipment 130 with respect to the wellbore 120. The walls of the casing 420 have an inner surface that forms a cavity 425 that traverses the length of the casing 420. The casing 420 can be made of one or more of a number of suitable materials, including but not limited to steel. In certain example embodiments, the casing 420 is made of an electrically conductive material. The casing 420 can have, at least along an inner surface, a coating of one or more of a number of electrically non-conductive materials. The thickness of such a coating can vary, depending on one or more of a number of factors, such as the imbalance in current density between the tubing string 410 and the casing 420 that must be overcome to maintain the electric circuit.

The tubing string 410 includes a number of tubing pipes (e.g., tubing pipe 411, tubing pipe 412, tubing pipe 413, tubing pipe 414, tubing pipe 485, tubing pipe 416, tubing pipe 417, tubing pipe 418) that are mechanically coupled to each other end-to-end, usually with mating threads. The tubing pipes of the tubing string 410 can be mechanically coupled to each other directly or using a coupling device, such as a coupling sleeve or an example isolator sub (e.g., top isolator sub 440, bottom isolator sub 450), described below. In some cases, more than one tubing string can be disposed within a cavity 425 of the casing 420.

Each tubing pipe of the tubing string 410 can have a length and a width (e.g., outer diameter). The length of a tubing pipe can vary. For example, a common length of a tubing pipe is approximately 30 feet. The length of a tubing pipe can be longer (e.g., 40 feet) or shorter (e.g., 10 feet) than 30 feet. The width of a tubing pipe can also vary and can depend on one or more of a number of factors, including but not limited to the inner diameter of the casing pipe. For example, the width of the tubing pipe is less than the inner diameter of the casing pipe. The width of a tubing pipe can refer to an outer diameter, an inner diameter, or some other form of measurement of the tubing pipe. Examples of a width in terms of an outer diameter can include, but are not limited to, 7 inches, 5 inches, and 4 inches.

Two tubing pipes (e.g., tubing pipe 416 and tubing pipe 417, tubing pipe 413 and tubing pipe 414) of the tubing string 410 can be mechanically coupled to each other using an isolator sub (e.g., top isolator sub 440, bottom isolator sub 450, respectively). In such a case, the tubing string 410 can be divided into segments. For example, as shown in FIG. 4, the portion (e.g., tubing pipe 417) of the tubing string 410 located above the top isolator sub 440 can be called the top neutral section 481, and the portion (e.g., tubing pipe 414, tubing pipe 485, tubing pipe 418) of the tubing string 410 located below the bottom isolator sub 450 can be called the bottom neutral section 483. As another example, the portion (e.g., tubing pipe 416, tubing pipe 412, tubing pipe 413) of the tubing string 410 located between the top isolator sub 440 and the bottom isolator sub 450 can be called the power-transmitting section 482.

The size (e.g., outer diameter, length) of the tubing string 410 is determined based, in part, on the size of the cavity 425 within the casing 420. The walls of the tubing string 410 have an inner surface that forms a cavity 419 that traverses the length of the tubing string 410. The tubing string 410 can be made of one or more of a number of suitable materials, including but not limited to steel. The one or more materials of the tubing string 410 can be the same or different than the materials of the casing 420. In certain example embodiments, the tubing string 410 is made of an electrically conductive material. However, the tubing string 410 should not "electrically" contact the casing 420, so that the circuit is maintained. The tubing string 410 can have, at least along an outer surface, a coating of one or more of a number of electrically non-conductive materials. In such a case, the coating of an electrically insulating material can be thick and rugged so as to complete the 'insulation' system for the necessary voltage requirement of a given application.

The power source 460 can be any device (e.g., generator, battery) capable of generating electric power that can be used to operate the SCSSV 490, described below. In certain example embodiments, the power source 460 is electrically coupled to the tubing string 410. Specifically, the power source 460 can be coupled to a portion of the power-transmitting section 482 of the tubing string. The power source 460 can be electrically coupled to the tubing string 410 wirelessly and/or using one or more electrical conductors (e.g., a cable). For example, as shown in FIG. 4, cable 405 can be used to electrically couple the power source 460 to the top end of the power-transmitting section 482 of the tubing string 410. In certain example embodiments, cable 405 is capable of maintaining a high current density connection between the power source 460 and the power-transmitting section 482 of the tubing string 410. In certain example embodiments, high current densities are needed when higher voltages cannot be accommodated safely or reliably.

As an example, in 10,000 foot wellbore 120 (which can include or be in addition to a depth of water 203 between the water level 210 and the mudline 202, if any), the total string (tubing string 410 and casing 420) resistance can be approximately 3 Ohms. If the current that is required by the SCSSV 490 is 100 amperes, then the power source 460 must provide 300 volts ($100\ A \times 3\Omega = 300\ V$) above that used by the SCSSV 490. The reason that an extra 300 V is needed is because the 300 V is lost to the tubing string 410 and the casing 420, and so the SCSSV 490 does not receive the 300 V. In view of these losses caused by the tubing string 410 and the casing 420, a SCSSV 490 using a high (e.g., 1000 A) amount of amperage may be beyond a practical application as the voltage loss (e.g., 3000V) through the tubing string 410 and the casing 420 may exceed practical electrical and/or hardware configurations.

The power generated by the power source 460 can be alternating current (AC) power or direct current (DC) power. If the power generated by the power source 460 is AC power, the power can be delivered in one phase. The power generated by the power source 460 can be conditioned (e.g., transformed, inverted, converted) by a power conditioner (not shown) before being delivered to the tubing string 410. In certain example embodiments, one pole (e.g., the "hot" leg of a single phase AC current) of the power generated by the power source 460 can be electrically coupled to the tubing string 410, while another pole (e.g., the neutral leg of a single phase AC current) can be electrically coupled to the casing 420. In such a case, a complete circuit can be created between the tubing string 410 and the casing 420, using other components of the delivery system 475 described below.

In certain example embodiments, the top isolator sub 440 is positioned between, and mechanically coupled to, the top neutral section 481 of the tubing string 410 and the power-transmitting section 482 of the tubing string 410. In such a case, the top isolator sub 440 electrically isolates (or electrically separates) the top neutral section 481 of the tubing string 410 from the power-transmitting section 482 of the tubing string 410. In addition, the top isolator sub 440 can electrically isolate the casing 420 from the tubing string 410. An amount of voltage and/or current generated by the power source 460 (described below) can, in part, determine the size and/or features of the top isolator sub 440 that is used for a given application.

In certain example embodiments, the top isolator sub 440 has a cavity that traverses therethrough. In such a case, the cavity of the top isolator sub 440 can be substantially the same size as the cavity 419 of the tubing string 410. Thus, when the top isolator sub 440 is positioned between and mechanically coupled to the top neutral section 481 of the tubing string 410 and the power-transmitting section 482 of the tubing string 410, a continuous passage traverses therethrough.

Similarly, in certain example embodiments, the bottom isolator sub 450 is positioned between, and mechanically coupled to, the bottom neutral section 483 of the tubing string 410 and the power-transmitting section 482 of the tubing string 410. In such a case, the bottom isolator sub 450 electrically isolates the bottom neutral section 483 of the tubing string 410 from the power-transmitting section 482 of the tubing string 410. In addition, the bottom isolator sub 450 can electrically isolate the casing 420 from the tubing string 410. An amount of voltage and/or current generated by the power source 460 (described below) can, in part, determine the size and/or features of the bottom isolator sub 450 that is used for a given application. Other factors that can affect the size and/or features of the bottom isolator sub 450 can include, but are not limited to, the length of the power-transmitting section 482, the size (e.g., inner diameter, outer diameter) of the tubing string 410, and the material of the tubing string 410.

As with the top isolator sub 440, the bottom isolator sub 450 has a cavity that traverses therethrough. In such a case, the cavity of the bottom isolator sub 450 can be substantially the same size as the cavity 419 of the tubing string 410. Thus, when the bottom isolator sub 450 is positioned between and mechanically coupled to the bottom neutral section 483 of the tubing string 410 and the power-transmitting section 482 of the tubing string 410, a continuous passage traverses therethrough. Electrically, in certain example embodiments, an isolator sub (e.g., top isolator sub 440, bottom isolator sub 450) behaves like a dielectric break in an otherwise solid piece of the power-transmission section of the tubing string 410. In actual practice, such an isolator sub fits within the cavity 425 of the casing 420 with sufficient clearance from the walls of the casing 420, exhibits low end-to-end capacitance, and is able to standoff many hundreds of volts of applied potential.

In accordance with example embodiments, a technique for electrical isolation includes a ceramic and/or other electrically non-conductive insulator inserted in series with tubing pipes of the tubing string 410. This may be, for example, built-in to a section of pipe that is relatively short (e.g., four foot section) relative to the length of a tubing pipe. The word "sub" for the isolator subs described herein is used to designate that the length of an isolator sub, having such electrically non-conductive properties, can be of relatively short length. The ceramic and portions of the tubing string 410 may be clamped together and can be connected without creating an electrical short in the tubing string 410. An insulating coating may be applied to the internal and external surfaces of the tubing string 410 and/or the shell of the isolator sub as electrical breakdown protection across the gap between the tubing string 410 and the shell of the isolator sub.

In an example, a field test of an isolator sub called a "Gap-sub" was conducted where approximately 300 $V_{rms}$ and 75 A was applied to the tubing string 410. In this case, the delivery system 475 could support the SCSSV 490 with a 15 horsepower (HP) rating at a depth within the wellbore 120 (including depth of the water 203) of approximately 1000 feet. In this example, approximately 350 $V_{rms}$ was generated by the power source 460 and delivered to the tubing string 410 so that approximately 300 $V_{rms}$ was delivered to the SCSSV 490. Field applications at greater depths (e.g., 10,000 feet) using example embodiments can require higher voltages (e.g., 1200 $V_{rms}$, 2500 $V_{rms}$) generated by the power source 460.

An isolator sub (e.g., top isolator sub 440, bottom isolator sub 450) is capable of withstanding one or more of a number of environmental conditions in the wellbore 120. In addition to supporting the weight of the remainder of the downhole portion of the delivery system 475 (which is a critical aspect of the top isolator sub 440 because the top isolator sub 440 is positioned at the top end of the tubing string 410), as described above, an isolator sub can resist torque, torsion, bending, and/or any other force that could impact the mechanical integrity of the isolator sub. These latter characteristics are important for the bottom isolator sub 450, which is mechanically coupled to the bottom neutral section 483 of the tubing string 410 and then gradually inserted further into the wellbore 120 as the various tubing pipes of the power-transmitting section 482 of the tubing string 410 is made up (mechanically coupled to each other, commonly using mating threads and thus a rotational motion).

The isolator sub can also be equipped to be impervious to fluids and/or gases within the cavity 425 of the casing 420. Such fluids and gases are one or more of a number of fluids and gases found within the wellbore 120 of the subterranean formation 110. Further, the isolator sub can withstand temperatures in excess of 600° F. or 750° F. For example, within a wellbore, it is not uncommon to encounter steam in excess of 600° F., and so each isolator sub can be able to sustain operation and mechanical integrity while being exposed to such temperatures.

An optional power conditioner (not shown) can be disposed within the cavity 425 of the casing 420 proximate to the bottom isolator sub 450. For example, the power conditioner can be located below the bottom isolator sub 450. The power conditioner can also be disposed outside of and/or integral with the tubing string 410. In such a case, the power conditioner can have a feature substantially similar to the top isolator sub 440 and the bottom isolator sub 450 in that the power conditioner can have a cavity that traverses therethrough. In such a case, the cavity of the power conditioner can be substantially the same size as the cavity 419 of the tubing string 410. Thus, when the power conditioner is positioned between and mechanically coupled to portions (e.g., tubing pipe 414, tubing pipe 418) of the bottom neutral section 483 of the tubing string 410, a continuous passage traverses therethrough.

In certain example embodiments, the power conditioner is electrically coupled to the tubing string 410. Specifically, the power conditioner can be coupled to a portion of the power-transmitting section 482 of the tubing string 410. The power conditioner can be electrically coupled to the tubing string 410, for example, using one or more electrical conductors (e.g., a cable). For example, cable 415 can be used to electrically couple the power conditioner to the bottom end of the power-transmitting section 482 of the tubing string 410. In certain example embodiments, cable 415 is capable of maintaining a high current connection between the power conditioner and the power-transmitting section 482 of the tubing string 410.

The power received by the power conditioner can be the same type of power (e.g., AC power, DC power) generated by the power source 460. The power received by the power conditioner can be conditioned (e.g., transformed, inverted, converted) into any level and/or form required by the SCSSV 490 before being delivered to the SCSSV 490. For example, if the power conditioner receives single phase AC power, the power conditioner can generate 120V three phase AC power, which is sent to the SCSSV 490. As described herein the power conditioned by the power conditioner can be called conditioned power.

The SCSSV 490 is electrically coupled to the power conditioner or, if there is no power conditioner, to the power-transmitting section 482 of the tubing string 410. The SCSSV 490 uses electric power (e.g., conditioned by the power conditioner) to operate within the wellbore 120. As described above, the power received by the SCSSV 490 from the delivery system 475 allows the SCSSV 490 to remain open, allowing production fluid from downhole in the wellbore 120 to flow through production tubing to the surface 210. In this case, the production tubing is the portion (i.e., tubing pipe 418, tubing pipe 411) of the tubing string 410 that is located further into the wellbore 120 than the SCSSV 490. When the SCSSV 490 stops receiving power from the delivery system 475, the SCSSV 490 closes, which prevents production fluid from downhole in the wellbore 120 from flowing beyond the production tubing to the surface 210.

In certain example embodiments, a conductive interface 499 is disposed below the bottom isolator sub 450 within the cavity of the casing 420. The conductive interface 499 can be electrically coupled to the SCSSV 490, either directly or using the tubing pipe 418. In such a case, the conductive interface 499 electrically couples the casing 420 to the tubing string 410. Thus, the casing 420 can be used as a return leg to complete the electric circuit that starts at the power source 460. The conductive interface 499 can be made of one or more of a number of electrically conductive materials. The conductive interface 499 can be a packer, a seal, an anchor assembly, or any other suitable device that can be placed within the wellbore 120.

A conventional interface at the conductive interface 499 may employ a design that ensures conductivity for the circuit. In certain example embodiments, the conductive interface 499 includes metallic (or otherwise electrically conductive) "teeth" that expand out to the casing 420 to anchor and seal the production area within the cavity 425. The anchoring or locating 'teeth' can establish the electrical current path, and special robust designs can be used in the practice of this invention.

Centralizing the tubing string 410 within the cavity 425 of the casing 410 may be a mechanical and/or electrical requirement for the operational use of example embodiments. A number of centralizers 430 can be disposed at various locations throughout the cavity 425 of the casing 420 between the casing 420 and the tubing string 410. In certain example embodiments, each centralizer 430 contacts both the outer surface of the tubing string 410 and the inner surface of the casing 420. Each centralizer 430 can have robust electrical insulation to prevent arc paths between the tubing string 410 and the casing 420.

Each centralizer 430 can be the same and/or different from the other centralizers 430 in the delivery system 475. A centralizer 430 can be made of and/or coated with one or more of a number of electrically non-conductive materials. Thus, each centralizer 430 can provide an electrical separation between the tubing string 410 and the casing 420. In certain example embodiments, the centralizer 430 can provide a physical barrier within the cavity 425 of the casing 420 between the casing 420 and the tubing string 410.

Thus, the electrical circuit formed by the power source 460, the power-transmitting section 482 of the tubing string 410, the optional power conditioner, the SCSSV 490, the conductive interface 499, and the casing 420 is not altered by arcing that can result between the tubing string 410 and the casing 420. A centralizer 430 design that, over time, would have a minimized surface for collection of surface debris (e.g., dirt) also may be useful for long life of the delivery system 475. A surface of a centralizer 430 with undesirable dirt collection could provide a path for undesirable voltage breakdown and inoperability of the delivery system 475.

High voltage breakdown is typically a short term event (i.e., short term to failure). Long term (i.e., months or years) exposure of conducting systems to high currents may impact all interfaces across which current passes, including welded and threaded joints. Shoe and slip contact from an anchor/packer to the wall of the casing needs to be robust to preserve the desired electrical pathway and electrical conductivity.

Figure 5:
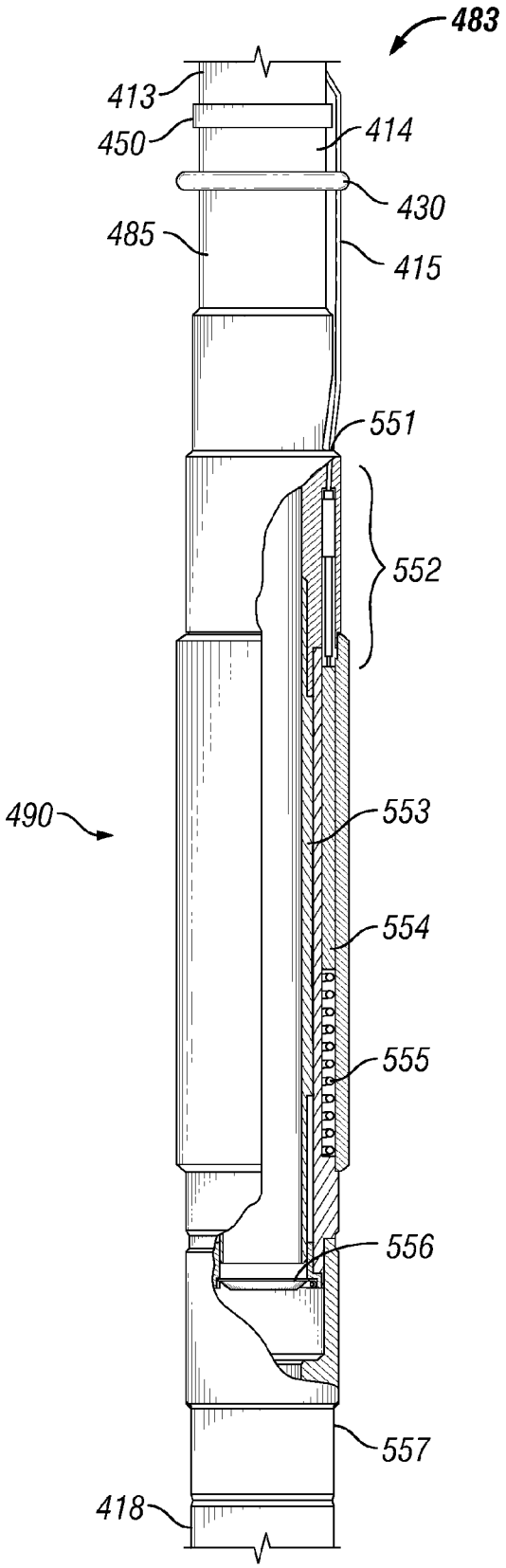
FIG. 5 shows a semi-cross-sectional side view of the bottom neutral section of FIG. 4 in accordance with one or more example embodiments.

FIG. 5 shows a semi-cross-sectional side view of the bottom neutral section 483 of FIG. 4 in accordance with one or more example embodiments. The bottom neutral section 483 of FIG. 5 includes tubing pipe 413, the bottom end of which is mechanically coupled to the bottom isolator sub 450. Below the bottom isolator sub 450 is mechanically coupled tubing pipe 414. Below (or over) the tubing pipe 414 can optionally be mechanically coupled centralizer 430. Below the optional centralizer 430 is mechanically coupled tubing pipe 485. Below tubing pipe 485 is mechanically coupled the SCSSV 490. The cable 415 is electrically coupled at the top end to the tubing 413, and the bottom end of the cable 415 is electrically coupled to the SCSSV 490. Finally, FIG. 5 shows that below the SCSSV 490 is mechanically coupled tubing pipe 418.

Referring to FIGS. 1-5, the SCSSV 490 of FIG. 5 includes one or more of a number of features. There are a number of designs and/or components that can be used in a SCSSV, and the design and components shown for the SCSSV 490 in FIG. 5 is one possible embodiment. In this case, the SCSSV 490 can include an upper sub 551, an actuator assembly 552, a flow tube 553, a coupling mechanism 554, a spring 555, a flapper 556, and a lower sub 557. The upper sub 551 and the lower sub 557 are transitional pieces that allow the SCSSV 490 to mechanically couple to the tubing pipe 485 and the tubing pipe 418, respectively.

In certain example embodiments, the actuator assembly 552 of the SCSSV 490 is coupled to the bottom end of the cable 415 and receives power through the cable 415. When the actuator assembly 552 receives power, the actuator assembly 552 keeps the spring 555, through the coupling mechanism 554 mechanically coupled between the actuator assembly 552 and the spring 555, in a compressed position. When the spring 555 is in a compressed position, the flapper 556 is held in an open position. When the flapper 556 is in the open position, then production fluid from the bottom of the wellbore 120 can flow up the tubing pipe 418, through the flow tube 553 in the SCSSV 490, through the tubing pipe 485, tubing pipe 414, isolator sub 450, and tubing pipe 413 toward the surface 102.

The power requirements of the SCSSV 490 can vary, both in terms of type used as well as in terms of point in time during a field operation. For example, in terms of the variation in power needed by a particular SCSSV, a higher amount of power (e.g., 5,000 Watts) may be required when opening the SCSSV or when equalizing the SCSSV, compared with normal operating conditions where a lower amount of power (e.g., 500 Watts) may be required to maintain the SCSSV in the open position.

When the actuator assembly 552 stops receiving power, the actuator assembly 552, through the coupling mechanism 554, releases the spring 555 from the compressed position. When the spring 555 is released from the compressed position, the flapper 556 is moved into a closed position. When the flapper 556 is in the closed position, then production fluid from the bottom of the wellbore 120 is prevented from flowing up the tubing pipe 418. In other words, when the flapper 556 is in the closed position, the production fluid at the bottom of the wellbore 120 is kept toward the bottom of the wellbore 120 and cannot get to the surface 102.

Figure 6:
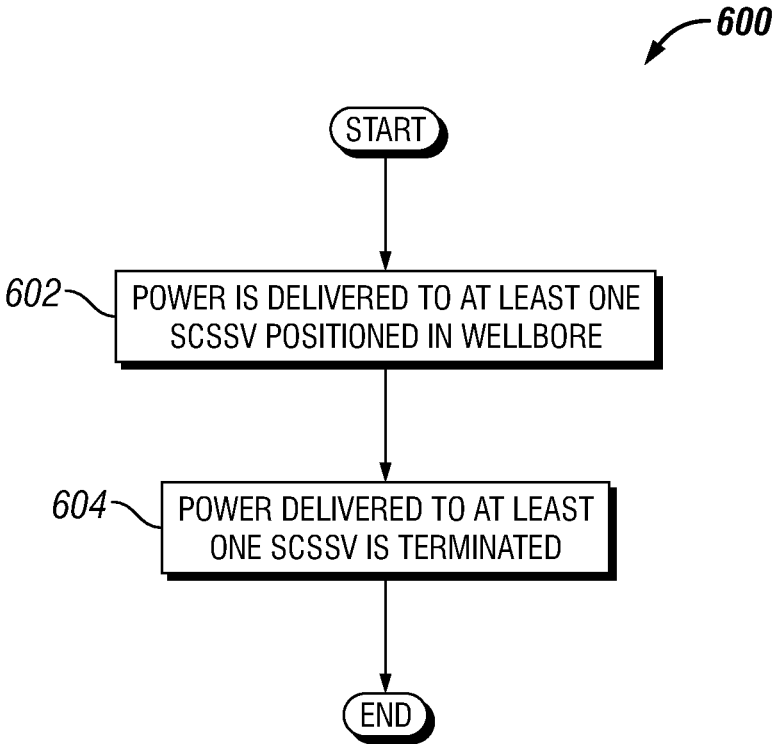
FIG. 6 shows a flow chart of a method for closing off production tubing disposed in a wellbore of a subterranean formation in accordance with one or more example embodiments.

FIG. 6 shows a flow chart of a method for closing off production tubing disposed in a wellbore of a subterranean formation in accordance with one or more example embodiments. While the various steps in this flowchart are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIG. 6, may be included in performing these methods. Accordingly, the specific arrangement of steps shown in FIG. 6 should not be construed as limiting the scope.

Referring now to FIGS. 1 through 6, the example method 600 begins at the START step and continues to step 602. In step 602, power is delivered to at least one SCSSV 490 positioned in the wellbore 120. The power can be generated by a power source 460 and delivered using a delivery system. An example of such a delivery system for the power can be the system 400 described above with respect to FIG. 4. There can be one SCSSV 490 or a number of SCSSVs 490 positioned (e.g., in series) in the wellbore 120. The SCSSV 490 can be mechanically coupled in series with a first tubing string (e.g., tubing pipe 418, tubing pipe 411) disposed below the SCSSV 490 in the wellbore 120 and a second tubing string (e.g., tubing pipe 485, tubing pipe 414) disposed above the SCSSV 490 in the wellbore 120. The first tubing string can also be called production tubing.

In certain example embodiments, the power delivered to the SCSSV 490 holds the SCSSV 490 in an open position. For example, the SCSSV 490 can include an actuator assembly 552 that, when receiving power, holds a spring 555 of the SCSSV 490 in compression. When the spring 555 is held in compression, a flapper 556 is held in an open position. In such a case, fluids (e.g., production fluid) from downhole in the wellbore 120 can flow through the SCSSV 490 to the surface 102, the mudline 202, and/or a water level 210.

In step 604, the power delivered to the SCSSV 490 is terminated. The power delivered to the SCSSV 490 can be terminated based on detecting an operating condition in the wellbore 120, where the operating condition surpasses (e.g., exceeds, falls below) an operating threshold value. For example, the operating condition can be a pressure, and when the pressure is too high or too low, a pressure threshold value can be surpassed. In such a case, a control system (e.g., part of the field equipment 130) terminates the power (e.g., turn off the power source 460, open a switch) delivered to the SCSSV 490.

In certain example embodiments, the SCSSV 490 closes when the power delivered to the SCSSV 490 is terminated. For example, when the power delivered to the SCSSV 490 is terminated, the actuator assembly 552 releases the spring 555 from compression. When the spring 555 is released from compression, the flapper 556 is moved into a closed position. In such a case, the fluids from downhole in the wellbore 120 can no longer flow through the SCSSV 490. When the power delivered to the SCSSV 490 is terminated, the method 600 ends at the END step.

The systems, methods, and apparatuses described herein allow for electrically-powered SCSSVs within a wellbore. Operation of the example embodiments described herein do not use hydraulics or Nitrogen. Major components for delivering power to the SCSSV can include conventional oil production tubing pipe, conventional oilfield production casing pipe, multiple example isolator subs, and insulation systems. Such insulation systems may be designed to insulate the tubing string from the casing at each end of the wellbore. Further, there may be a conductive interface (e.g., anchor, packer assembly) that may provide electrical conductive contact from the production tubing to the casing, providing a return circuit toward the end of the tubing string.

Using example embodiments described herein, it is possible to use the existing metallic (or otherwise electrically conductive) structure of the constructed well as the electrical conductor to supply energy to one or more SCSSVs located within a wellbore. For example, embodiments may be employed to supply power of approximately 5 kW when the SCSSV is equalizing and open, and approximately 500 W to sustain the SCSSV in the open position, although less or more power could be employed. Supply of power using existing wellbore hardware, such as a tubing string and casing, may reduce or eliminate the need for conventional power cabling completion insertions. The application of example embodiments may employ relatively high current and moderately high voltage use of the well structure.

The use of an electrically-powered SCSSV, as described herein, provides a number of advantages over safety valves currently used in the field. For example, electrically-powered SCSSVs described herein are not sensitive to pressures at lower wellbore depths. As a result, example electrically-powered SCSSVs can be used at essentially any setting depth. Using example electrically-powered SCSSVs also provides significant costs savings, a higher level of reliability, easier installation, and easier maintenance.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A subsurface safety valve system for a wellbore within a subterranean formation, the system comprising:

a power source that generates power;

a delivery system disposed within the wellbore and electrically coupled to the power source, wherein the delivery system delivers the power generated by the power source, wherein the delivery system comprises a tubing string, wherein the tubing string comprises a plurality of electrically conductive tubing pipes mechanically coupled end-to-end and through which the power flows;

at least one safety valve disposed within the wellbore and electrically coupled to the delivery system, wherein the at least one safety valve remains open while the at least one safety valve receives the power from the delivery system, and wherein the at least one safety valve closes when the at least one safety valve stops receiving power from the delivery system; and production tubing mechanically coupled to a distal end of the at least one safety valve, wherein the production tubing comprises a cavity, wherein the at least one safety valve shuts in the cavity when the at least one safety valve closes.

2. The system of claim 1, wherein the delivery system further comprises:

a casing disposed within the wellbore and comprising a plurality of electrically conductive casing pipes mechanically coupled end-to-end, wherein the casing has a first cavity running therethrough;

a first isolator sub mechanically coupled to and positioned between a top neutral section and a power-transmitting section of the tubing string, wherein the first isolator sub has a second cavity running therethrough, and wherein the first isolator sub electrically separates the casing from the tubing string and the top neutral section from the power-transmitting section; and a second isolator sub mechanically coupled to the tubing string and positioned between a bottom neutral section and the power-transmitting section of the tubing string, wherein the second isolator sub has the second cavity running therethrough, and wherein the second isolator sub electrically separates the casing from the tubing string and the bottom neutral section from the power-transmitting section, wherein the at least one safety valve is disposed below the second isolator sub and is electrically coupled to a bottom end of the power-transmitting section of the tubing string, wherein the tubing string is disposed within the first cavity without contacting the casing, wherein the top neutral section of the tubing string is positioned proximate to an entry point of the wellbore, wherein the bottom neutral section of the tubing string is positioned toward a distal end of the wellbore, wherein the power-transmitting section of the tubing string is positioned between the top neutral section and the bottom neutral section, and wherein the tubing string has the second cavity running therethrough.

3. The system of claim 2, further comprising:

a conductive interface disposed below the second isolator sub within the first cavity, wherein the conductive interface electrically couples the casing and the tubing string.

4. The system of claim 3, wherein the conductive interface comprises at least one selected from a group consisting of a packer, an anchor assembly, and a seal.

5. The system of claim 4, further comprising:

packer fluid disposed inside the first cavity between the casing, the conductive interface, and the tubing string, wherein the packer fluid has a fluid weight of up to 16 pounds per gallon.

6. The system of claim 2, wherein the casing is an electrical ground for an electric circuit that comprises power generated by the power source.

7. The system of claim 2, wherein the power source is further electrically coupled to the casing.

8. The system of claim 2, wherein the first isolator sub comprises material that can withstand temperatures above 600° F.

9. The system of claim 2, wherein the first isolator sub is impervious to fluids and gases.

10. The system of claim 9, wherein the first isolator sub comprises a plurality of sealing devices.

11. The system of claim 2, wherein the first isolator sub mechanically supports a weight in excess of 100,000 pounds, wherein the weight is comprised of the power-transmitting section of the tubing string, the bottom neutral section of the tubing string, and the second isolator sub.

12. The system of claim 2, further comprising:

a plurality of centralizers disposed inside the first cavity between the power-transmitting section of the tubing string and an inner wall of the casing, wherein the plurality of centralizers are made of an electrically non-conductive material.

13. The system of claim 2, wherein the electrical device is, at least in part, electrically coupled to the power-transmitting section of the tubing string using a cable capable of transmitting a high current density.

14. The system of claim 1, wherein the at least one safety valve receives at least 400 Watts of power from the power source.

15. The system of claim 1, further comprising:

a control system operatively coupled to the power source, wherein the control system detects an emergency condition and instructs the power source to stop generating the power upon detecting the emergency condition.

16. The system of claim 1, wherein the at least one safety valve is positioned toward a bottom of the wellbore.

17. The system of claim 1, wherein the wellbore is located under water, wherein the delivery system is also disposed between a water level and a mudline, wherein the wellbore is located under the sea floor, and wherein the power source is located above the water level.

18. The system of claim 17, wherein the at least one safety valve is located at least 150 feet below the mudline within the wellbore.

19. A method for closing off production tubing disposed in a wellbore of a subterranean formation, the method comprising:

delivering, using a delivery system, power to at least one safety valve positioned in the wellbore, wherein the at least one valve is mechanically coupled in series with a first tubing string and a second tubing string, wherein the first tubing string is disposed below the at least one safety valve, and wherein the second tubing string is disposed above the at least one safety valve, wherein the power holds open the at least one safety valve, wherein the delivery system comprises the second tubing string, wherein the second tubing string comprises a plurality of electrically conductive tubing pipes mechanically coupled end-to-end and through which the power flows to the at least one safety valve; and terminating, in response to detecting an operating condition that surpasses an operating threshold value, the power delivered to the at least one safety valve, wherein the at least one safety valve closes when the power is terminated.

20. The method of claim 19, wherein the operating condition comprises a pressure within the wellbore.

* * * * *